United States Patent [19]

Harrison et al.

[11] Patent Number: 4,616,935

[45] Date of Patent: Oct. 14, 1986

[54] APPARATUS AND PROCESS FOR BOILER ASH COLLECTION

[75] Inventors: James E. Harrison; John B. Presnell, both of Port St. Joe, Fla.

[73] Assignee: St. Joe Forest Products Company, Port St. Joe, Fla.

[21] Appl. No.: 683,584

[22] Filed: Dec. 19, 1984

[51] Int. Cl.[4] ..... B01F 15/02

[52] U.S. Cl. ..... 366/165; 209/11; 210/512.2; 366/139; 366/178

[58] Field of Search ..... 366/150, 165, 167, 173, 366/174, 177, 178, 189, 139; 209/11, 12, 21; 210/512.2; 122/215, 216, 217, 171; 15/301

[56] References Cited

U.S. PATENT DOCUMENTS

| | | | |
|---|---|---|---|
| 3,794,299 | 2/1974 | Wagner | 366/165 |
| 4,077,612 | 3/1978 | Ricciardi | 366/165 |
| 4,363,674 | 12/1982 | Fullenwider | 15/301 |
| 4,436,703 | 3/1984 | Lane | 366/167 |
| 4,498,819 | 2/1985 | El-Saie | 366/165 |

*Primary Examiner*—Robert W. Jenkins

*Attorney, Agent, or Firm*—Arthur G. Yeager

[57] ABSTRACT

An apparatus for continuously mixing dust and water for disposal of the dust, the apparatus including a vertical pipe with a removable cover at its upper end, an inlet pipe adapted to deliver dust particles into the vertical pipe, a mixing chamber closed at the upper end except for the lower end of the vertical pipe discharging thereinto, the lower end of the chamber being open and submerged in a pool of water, water inlets adjacent to the upper end of the chamber directing water tangentially over the walls of the chamber, a water inlet into the pool of water, and an overflow outlet from the pool to remove a mixture of dust and water from the apparatus. A process which includes classifying ash particles from an industrial boiler, passing the smaller particles into an enclosed zone with water washing the walls of the zone and the bottom of the zone opening underneath the level of a pool of water which overflows to discharge a mixture of water and dust for disposal. The invention is useful in collecting ash particles continuously for disposal without pollution.

9 Claims, 2 Drawing Figures

APPARATUS AND PROCESS FOR BOILER ASH COLLECTION

BACKGROUND OF THE INVENTION

Power plants that burn solid fuel have large amounts of ash that must be removed from the boiler and disposed of in a manner that is environmentally acceptable. Heavy solid particles of ash are usually dumped under or forward of the fire bed and accumulate in pit from which the ash is removed periodically or continually by mechanical means. Very light ash particles are crried by the flue gases that eventually rise through a stack for discharge to the atmosphere. These particles are usually removed from the flue gases by a dry dust collector followed by wet scrubbing or by an electrostatic precipitator. In between the heavy solids and the very light solids are the intermediate solids which are heavy enough to settle out from quiescent gases, but light enough to be carried along by a moving gas stream. Such particles may be as large as can be carried by the moving gas stream, although they usually are not larger than about 0.10 inch in diameter. Normally the intermediate solids are dumped into a hopper and removed from the hopper by a rotary seal valve which removes the ash without disturbing the vacuum in the boiler. This procedure has been unsatisfactory because there is no visible means for seeing whether the system is working, and in any event the wear and tear on rotary feeders is so great that there is too much maintenance for an economical operation.

It is an object of this invention to provide an improved method and apparatus for removing ash from the flue gases leaving the boiler. It is another object of this invention to provide a more economical means for removing ash from boilers. Other objects will appear from the more detailed description of this invention which follows.

BRIEF DESCRIPTION OF THE INVENTION

This invention relates to an apparatus for continuously mixing dust and water for disposal purposes, comprising a pipe with a removble cover at its upper end and with its lower end opening into a chamber, an inlet opening into said pipe for introducing dust particles thereinto, said chamber having its upper end closed except for said pipe and its lower end submerged in a pool of water, a plurality of substantially horizontal, tangentially directed water inlets discharging into the upper end of said chamber, an inlet for introducing water into said pool, and an overflow outlet for removing a mixture of water and dust from said pool.

In specific embodiments of the invention the pipe with a removable cover is vertical and the inlet is a pipe positioned at an acute angle to the vertical pipe, the water inlets to the mixing chamber are directed so as to wash the walls, and the chamber is frustoconical in shape with the large end being the upper portion of the chamber.

This invention also relates to a continuous process for collecting for disposal small particles of ash generated in in industrial boiler, comprising classifying said ash to remove particles larger than about 0.10 inch in diameter, continuously passing those particles smaller than about 0.10 inch into the top of an enclosed mixing zone having a pool of water in the bottom thereof and having the sole exit from that zone being through the water in said pool, continuously introducing water into said zone so as to wash the walls of said zone, and continuously removing from said pool a mixture of water with ash particles dispersed therein.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
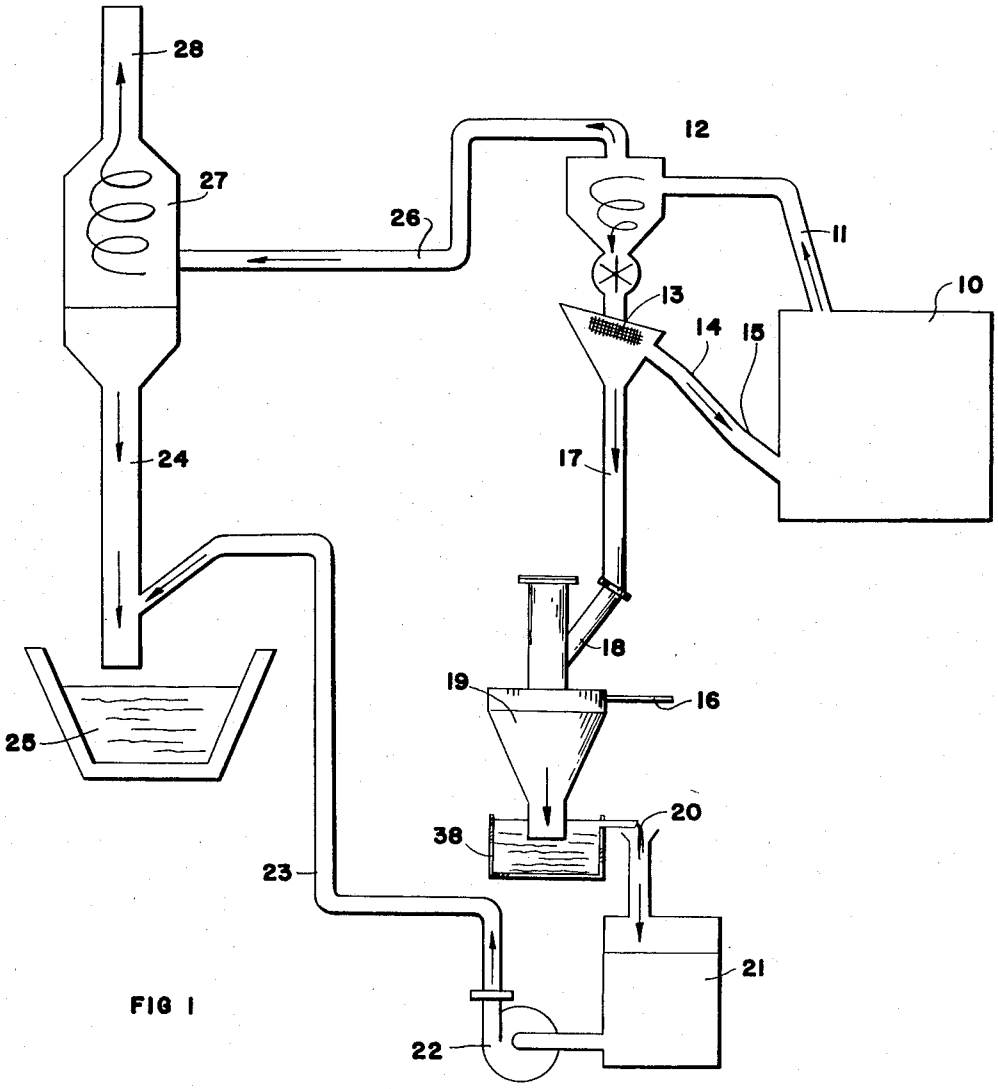
FIG. 1 is a schematic flow diagram of the process of this invention.

In FIG. 1 there is shown a flow diagram of the process of this invention employing the apparatus of the invention. Boiler 10 burns solid fuel with ash and flue gases leaving through conduit 11 to cyclone separator 12 where the extremely light particles and the gases are separated from the remaining particles which fall through the bottom of separator 12 into a classifier 13 which separates large particles from intermediate and small particles. The large particles are returned to boiler 10 through pipes 14 and 15. Small and intermediate ash particles, e.g., up to about 0.10 inch in diameter, pass through classifier 13 and are conducted through pipe 17 to inlet 18 of the mixing chamber apparatus 19 of this invention. Water is also introduced at 16 into apparatus 19 and a mixture of water and the ash particles flow into vessel 38 and overflow from spout 20 into holding tank 21. Pump 22 forces the mixture through pipe 23 to join a similar watery mixture in pipe 24 being discharged into a disposal ditch 25 or into any other desired disposal site or disposal means. Very small particles leaving separator 12 with the gases are conducted through pipe 26 to separator 27 where the small particles are removed and washed with water into pipe 24 to be discharged into disposal ditch 25. Gases, free of particles, are discharged through stack 28 to the atmosphere.

Figure 2:
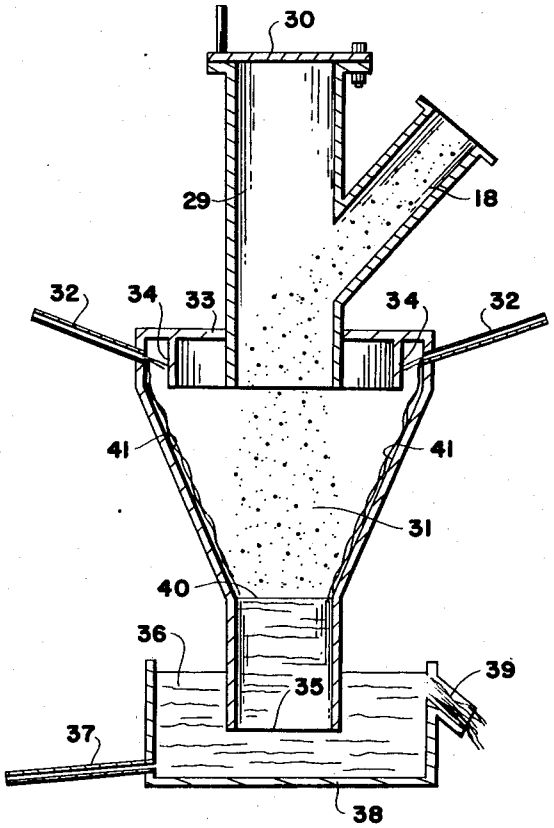
FIG. 2 is an elevational view of the apparatus of this invention.

FIG. 2 shows the detailed characteristics of the apparatus of this invention, referred to as mixing chamber apparatus 19 in the above description of FIG. 1. Dust, ash, and sand particles enter the apparatus through an inlet pipe 18 which opens into inspection pipe 29. Removable cover 30 on pipe 29 permits inspection and clean out if the apparatus should become plugged.

The lower end of inspection pipe 29 opens into an enclosed chamber 31, preferably an inverted frustoconical shape, i.e., with the large end of the conical shape at the top and the small end at the bottom. Cover 33 closes the top of chamber 31 except for pipe 29. Tapering conical walls 41 are continuously washed with water from a plurality of inlets 32 spaced around the chamber adjacent cover 33 and directed generally horizontally and tangentially so as to produce as little splashing as possible. Two to four such inlets are preferred. In order to provide additional protection against splashing, which interferes with the smooth introduction of the particles into the water, there is provided an annular ring 34 to serve as a splash shield. At the lower end of chamber 31 water collects in a pool having sufficient water therein to serve as a hydraulic seal capable of preserving the vacuum in the boiler and in chamber 31. In the drawing that pool will have a level 40 inside the lower end of chamber 31 which may be equivalent to a head of 10–20 inches of water. The mixture of water and particles discharges through the bottom 35 of chamber 31 into a pool of water 36 in vessel 38 which overflows from spout 39. An additional water inlet 37 is preferred to maintain proper mixing of particles and water and to prevent any unacceptable amount of settling of the particles near bottom 35 that might cause plugging. The mixture overflowing at 39 is conducted to any convenient disposal site.

Inspection pipe 29 is shown as vertical in FIG. 2 with inlet pipe 18 positioned at an acute angle thereto discharging downwardly. It is also equally functional for the ash particles to be discharged from a horizontal or a vertical pipe into inspection pipe 29. If the ash particles are discharged vertically, inspection pipe 29 may be set at an acute angle thereto since inspection pipe 29 need only provide access to the discharge opening into chamber 31 to permit a rod or other device to be employed to break up any plugging bridge of particles across that opening.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. An apparatus for continuously mixing dust and water for disposal purposes, comprising a vertical pipe with a removable cover at its upper end and with its lower end opening into an enclosed chamber, an inlet opening into the side of said pipe at an acute angle thereto for introducing dust particles thereinto, said chamber having its upper end closed except for said pipe and said inlet and its lower end submerged in a pool of water, a plurality of water inlets discharging substantially horizontally and tangentially with respect to the walls of said chamber into the upper end of said chamber, an inlet for introducing water into said pool, an annular ring concentrically placed around the lower end of said pipe and spaced outwardly from said pipe and inwardly from said water inlets, an outlet for continuously removing a mixture of water and dust from said pool, and means for maintaining said chamber at subatmospheric pressure.

2. The apparatus of claim 1 in combination with an industrial boiler emitting dust particles which are introduced into said inlet, and said overflow is discharged into a settling basin.

3. The apparatus of claim 2 wherein said dust particles leaving said boiler are concentrated in a cyclone separator before being introduced into said inlet.

4. The apparatus of claim 2 wherein said dust particles comprise particles of ash derived from the fuel burned in the boiler.

5. The apparatus of claim 2 wherein said chamber is generally frustoconical in shape with the large cross-section at the top where said pipe with a removable cover enters and with the small cross-section of said chamber submerged in said pool of water.

6. The apparatus of claim 5 wherein said water inlets are positioned to discharge water tangentially against the inside surface of the conical walls of said chamber with substantially no splashing below said annular ring.

7. A continuous process for collecting and disposing of small particles of ash generated in an industrial boiler operating at subatmospheric pressure comprising classifying said ash to remove particles larger than about 0.10 inch in diameter, continuously passing those particles smaller than about 0.10 inch into the top of an enclosed mixing zone maintained at subatmospheric pressure and having a pool of water in the bottom thereof and having the sole exit from that zone below the level of water in said pool, continuously introducing water into said zone so as to wash the walls of said zone with substantially no splashing, and continuously removing from said pool a mixture of water with ash particles dispersed therein.

8. The process of claim 7 wherein said level of water in said pool is sufficiently high in elevation with respect to the discharge from said pool to function as a hydraulic seal for the operating vacuum of said boiler.

9. The process of claim 7 wherein the particles continuously processed are less than about 0.05 inch in diameter.

* * * * *